United States Patent [19]

Britton

[11] 3,997,158

[45] Dec. 14, 1976

[54] STRIKE-ZONE TARGET

[76] Inventor: Howard B. Britton, 96 W. Hill, Rittman, Ohio 44270

[22] Filed: Nov. 19, 1973

[21] Appl. No.: 416,901

Related U.S. Application Data

[63] Continuation-in-part of Ser. No. 275,215, July 26, 1972, abandoned.

[52] U.S. Cl. ..... 273/26 A

[51] Int. Cl.[2] ..... A63B 69/40

[58] Field of Search ..... 273/26 R, 26 A, 29 A, 273/102 R, 127 R, 127 B

[56] References Cited

UNITED STATES PATENTS

| | | | |
|---|---|---|---|
| 1,879,316 | 9/1932 | Kieb | 273/26 A |
| 2,126,102 | 8/1938 | Fowler | 273/26 A |
| 3,312,467 | 4/1967 | Dawson | 273/26 A |
| 3,583,703 | 6/1971 | Brown | 273/26 A |

OTHER PUBLICATIONS

Popular Mechanics, Aug., 1972, pp. 128–129.

*Primary Examiner*—Anton O. Oechsle
*Assistant Examiner*—T. Brown

[57] ABSTRACT

A strike-zone target is provided as an aid for youngsters and others learning to play baseball or practicing to improve their game. It is an aid to those wishing to improve their pitching, batting and fielding skills. It is formed of two vertical chains spaced wider than home plate is wide, and two horizontal chains with a hook at each end of each, which hooks are adapted to be removably fastened at different heights to the vertical chains for drawing these vertical chains together somewhat to define the strike-zone area. This target may be fastened to a wall or other structure intended for another use, but is preferably attached to a frame which may be erected in any suitable place and is preferably provided with attachments for batting practice.

15 Claims, 14 Drawing Figures

STRIKE-ZONE TARGET

This is a continuation-in-part of my application Ser. No. 275,215 filed July 26, 1972, and since abandoned.

The invention relates to a strike-zone target which is an aid to youngsters and older persons learning to play baseball, helping them in pitching, batting and fielding.

The strike-zone target is formed of two vertical chains or the like which are suitably supported, and two horizontal chains or the like which are removably fastened to the vertical chains, one above the other, so that their distances from the ground may be varied. These horizontal chains, with fastening means at each end draw the middle portions of the vertical chains together somewhat so that between the two horizontal chains, these vertical chains are properly spaced to provide a rectangular strike zone of a desired area. The location of the horizontal chains is changeable so that the lower chain may be adjusted to a height about equal to the knee height of a player and the upper chain may be adjusted to about his shoulder height. For a younger player the lower chain will usually be placed somewhat below his knees, and the upper chain level with the top of his shoulders. For an older player, the lower chain will usually be placed somewhat above his knees, and the upper chain at his shoulder pits. Thus the height of the strike zone may be adjusted to conform to the regulations of different play groups.

The target is preferably mounted in front of a backstop, usually vertical, which causes the return of the ball after it has passed by the target. This may be some sort of wall structure, or a net or other fabric structure supported by spring means.

There are several uses for the strike-zone target. It is primarily used to serve boys (or men) as an aid to a pitcher so that he will learn to pitch a ball into the strike zone or intentionally outside of the zone. The strike-zone target also may serve as an aid to boys (or men) practicing batting, who will stand parallel to the backstop, in the batter's box, a desired distance from the pitcher's box. The batter's coach and team mates can tell him whether he is striking at balls which come within or outside of the strike zone. Also, the strike-zone target, placed in front of a suitable backstop, may serve as an aid in fielding, particularly to a pitcher who learns to field balls rebounding from the backstop. Since he must learn to field balls which are not hit directly forward by a batter, a right-angular metal plate may be fixed vertically to the backstop within the strike zone so that some balls which are to be fielded will rebound to the left, and others to the right.

A pitched ball is considered a "strike" if any part of it passes over the home plate which is 17 inches wide. Therefore, the strike zone will normally be somewhat more than 17 inches wide, for example about 22 inches wide, so that if any part of a pitched ball passes over the home plate it will enter the strike zone without touching either of the vertical chains.

Practice may be conducted with a regular baseball or a soft ball. The backstop may be a fabric suitably supported from the frame. For a strike-zone target to be used without the frame with a baseball, a concrete or brick backstop may be preferred, and for a soft ball, a wooden backstop is satisfactory.

In using the strike-zone target, anyone can easily determine whether a pitched ball goes within the strike zone or outside of it. If the ball hits a chain that defines the strike zone, the chain vibrates and it is clear that the thrown ball is not a strike. Thus the pitcher or coach or any onlooker can readily see whether the pitcher is throwing the ball where he intends to throw it.

By the distance the ball rebounds from concrete or brick backstops, and less easily with a backstop that is not so hard, when there is no batter swinging at the ball, it can be readily determined whether a fast ball or slow ball has been thrown because of the distance the ball rebounds after hitting the backstop. Thus, it can be determined whether the pitcher has a good "change up." Certain areas of the target may be partioned off so that a pitcher can learn to pitch into a particular portion of the strike zone.

The target may be mounted on a frame on which the backstop is also mounted. Such a backstop is preferably a net. The frame is advantageously provided with openings at the corners to be used in positioning it, and for mounting one or more attachments, such as may be helpful to a person practicing batting.

Although the invention is designed primarily to teach youngsters, anyone may learn from its use.

The invention is further described in connection with the accompanying drawings, in which:

FIG. 6 is a front view of a differently modified strike-zone target;

Figure 1:
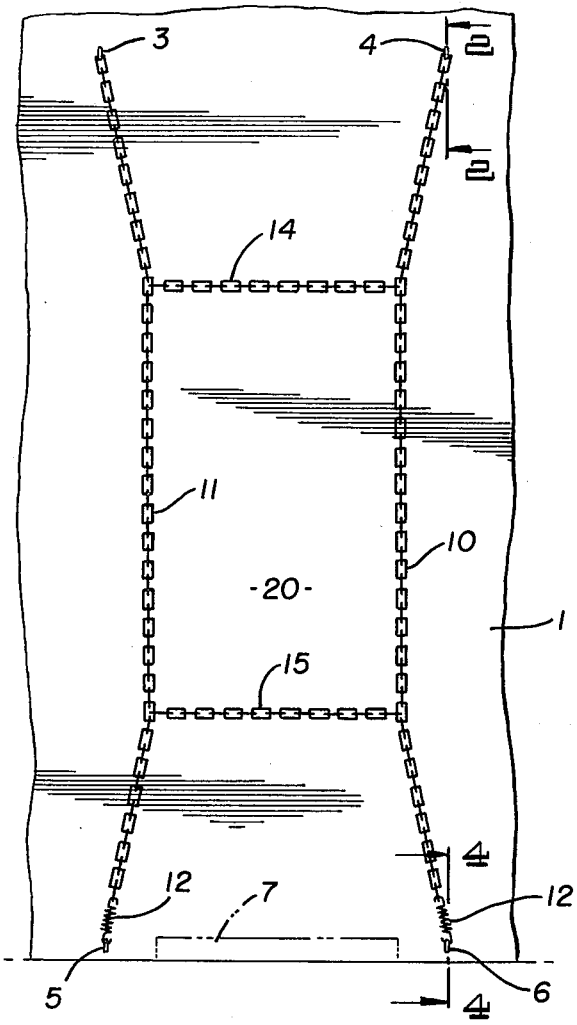
FIG. 1 is a front view of the strike-zone target when not used in the frame.
Figure 2:
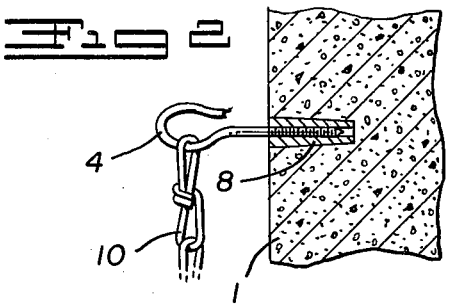
FIG. 2 is a view on the line 2—2 of FIG. 1.
Figure 3:
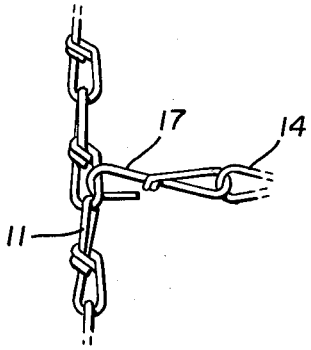
FIG. 3 is an enlarged detail of one end of a horizontal chain hooked into a vertical chain.
Figure 4:
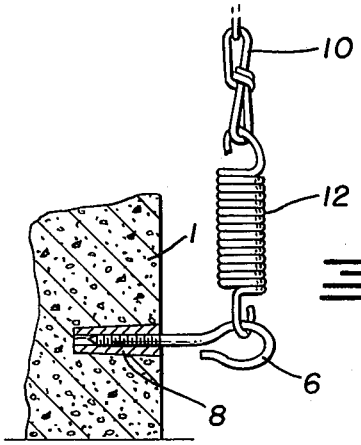
FIG. 4 is a view on the line 4—4 of FIG. 1.
Figure 5:
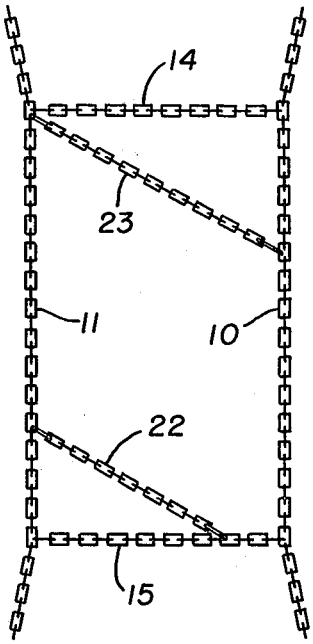
FIG. 5 is a front view of a modified strike-zone target which may be used with or without the frame.

Referring to the drawings, the backstop 1 is a wall of any suitable composition which merely provides for the pitched balls rebounding toward the pitcher. It may be a wall of a building or a wall specially built for the attachment of chains to define a strike zone, or it may be a fabric backstop in a frame.

The strike-zone target is mounted on the four hooks 3, 4, 5 and 6 suitably fastened to the backstop. Attaching means of any suitable construction may be used. The drawing illustrates the wall as concrete, with hooks 3, 4, 5 and 6 fastened in lag shields 8 driven into it. Vertical chains 10 and 11 held by these hooks are maintained taut by springs 12. Also, the springs cause the chains to vibrate when hit by a pitched ball, so that it is easily determined whether they have been hit.

The position of the home plate 7 (which is seventeen inches wide) is indicated as being at the level of the bottom of the backstop. Actually the bottom of the backstop may be buried in the ground or positoned above the ground. The strike-zone target 20 may be located out of doors in which case the backboard may be the wall of a building, and if the backstop is inside, it may be the wall of a room. If preferred, it may be an entirely separate structure used for nothing else.

As shown, the distance between the upper hooks 3 and 4 and between the lower hooks 5 and 6 is somewhat greater than the width of the home plate. The upper chain 14 and lower chain 15 are each provided at their ends with hooks 17 made by opening links of the chains. Other attachment means such as S-hooks, etc. may be used. These attaching means are engaged in the chains 10 and 11 and draw them together so that throughout the strike zone their inner edges are properly spaced. The location of the upper and lower chains 14 and 15 is easily adjusted from time to time, for batters of different heights.

An addition to the strike zone, as shown in FIG. 6, comprises additional chains, one chain 22 being about the length of the chains 14 and 15, and the other chain 23 being somewhat longer. These chains may be used to mark out areas for a "high and tight" pitch and a pitch which is "low and away" for a right-handed batter, and chains 22 and 23 may be interchanged for a left-handed batter.

Also, as shown in FIG. 6, vertical chains 26 and 27 may be used to mark out areas within the strike-zone to provide practice in pitching balls close to and farther from a right-handed or left-handed pitcher. Thus, the invention not only enables a pitcher to learn to throw a ball into the strike zone but also to control his pitch so that although it goes within the strike zone, it goes into a portion of the strike zone in which it is more difficult for the ordinary batter to hit it.

Instead of fastening the target to a wall or other permanent structure, it may be made self-contained with a backstop in a frame which can be supported by suitable means and moved from place to place, as desired.

Figure 7:
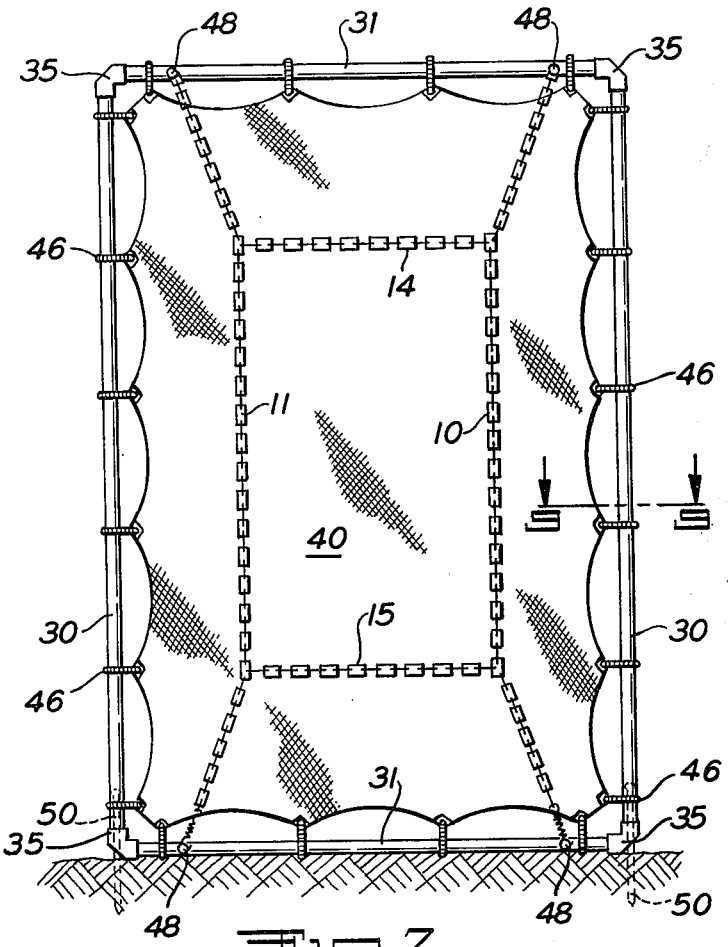
FIG. 7 is a front view of the target mounted in a frame.
Figure 8:
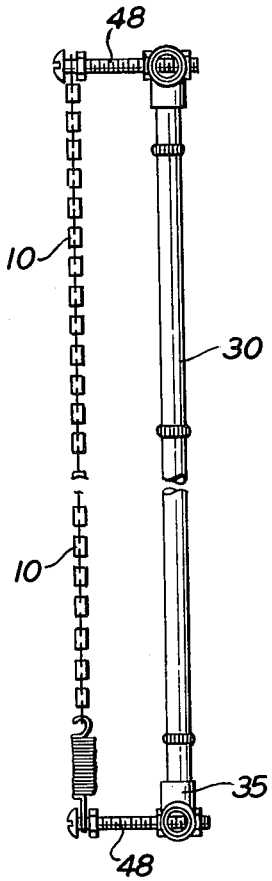
FIG. 8 is an enlarged, foreshortened vertical sectional view of the frame.
Figure 10:
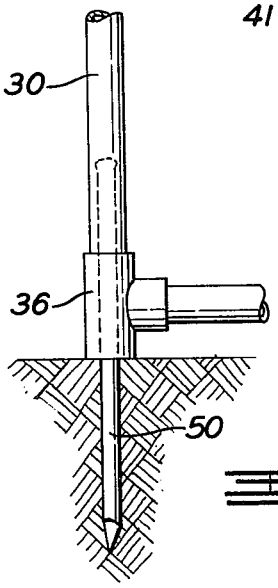
FIG. 10 is an enlarged detail of a modified lower corner of the frame supported in the ground.
Figure 8:
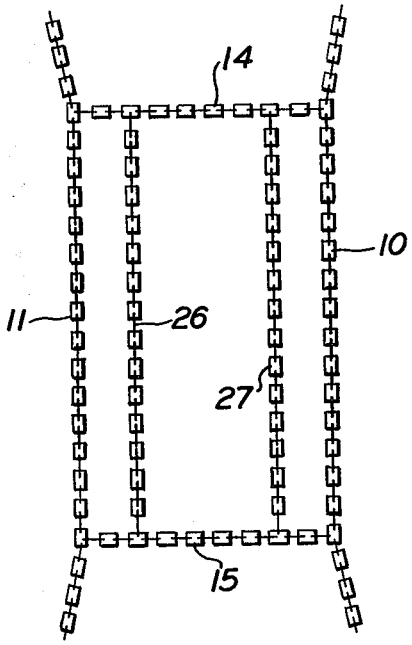

This frame may be made of plastic members, but is conveniently assembled from 2 larger pipes 30 and 2 shorter pipes 31 held together by any suitable fittings which provide the various uses shown. This necessitates at least one corner fitting with one or two additional openings to give direct-line access to the interior of one or more of the pipes united by the fitting. Such fittings are identified by the numeral 35 in FIGS. 7 and 8. There are now electrical fittings on the market suitable for this purpose. FIG. 10 shows the use of a more conventional fitting 36 — a 3-way corner fitting.

In order to assemble such a frame, means (not shown) will be required. For instance, a straight coupling with right- and left-hand threads on the outer surface of its two ends may be used between two sections of one of the pipes which is divided in two with proper threads on the exterior of its ends which are to be joined by the straight couplings.

The target is held a short distance in front of the backstop, usually by supporting the target by the frame a few inches, e.g. 2 to 5, in front of the target, as by studs 48 screwed into threaded openings in the pipes.

Figure 9:
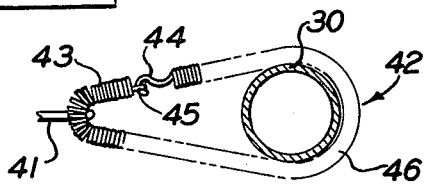
FIG. 9 is an enlarged sectional view of the frame on the line 8—8 of FIG. 6.

The backstop 40 is preferably strong netting. All edges of this backstop are extended toward the respective pipes by suitable means. A detail of preferred means is shown in FIG. 9, with suitable hook means 41 with one end engaged in the backstop and with the spring 42 hooked into the other end. The spring comprises a coil 43, with a hook 44 and eye 45 at its respective ends, with a short section of hose 46 enclosing the portion which contacts the pipe, which may be pipe 30. Such supporting means holds the backstop taut, but with sufficient give to permit it to be pushed back when hit by a ball, and then returned to its former position.

The frame may be supported by stakes 50 (FIGS. 7 and 20) driven into the ground or a concrete floor or other suitable base. The stakes extend through the openings in two corner fittings, into the pipes 30.

Figure 13:
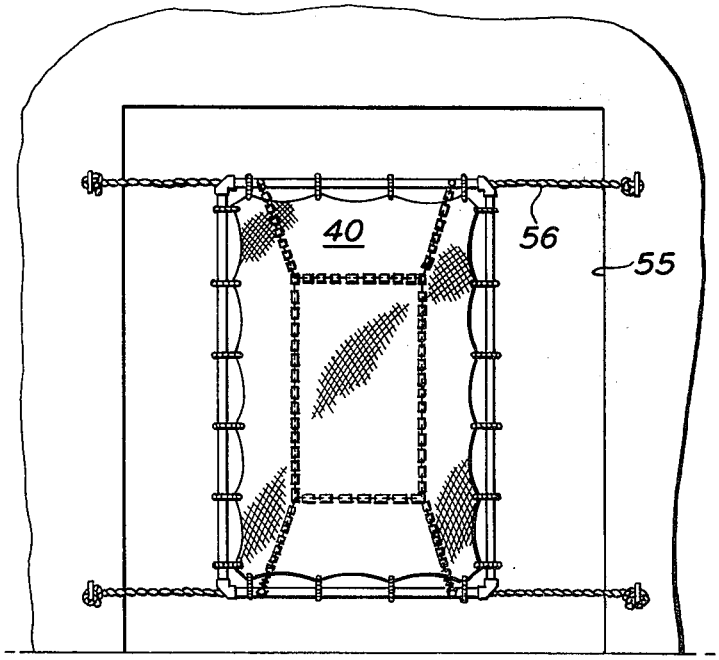
FIG. 13 is a front view of the target supported in a door way.

Alternatively, the target can be supported in a door way 55 or between posts or the like, by threading a rope or chain or other elongated member 56 through the upper pipe 31 and out through the upper corner fittings, as shown in FIG. 13. The bottom of the frame may be similarly fastened, as shown in this figure. It is possible that a long pole or rod or the like may be used instead of a flexible member. Instead of extending the ends of the member 56 to the sides of the doorway, the frame may be hung by fastening the ends of flexible member 56 to the top of the doorway. The bottom of the frame may not need fastening, and any desired means may be employed for fastening it, if required.

Figure 14:
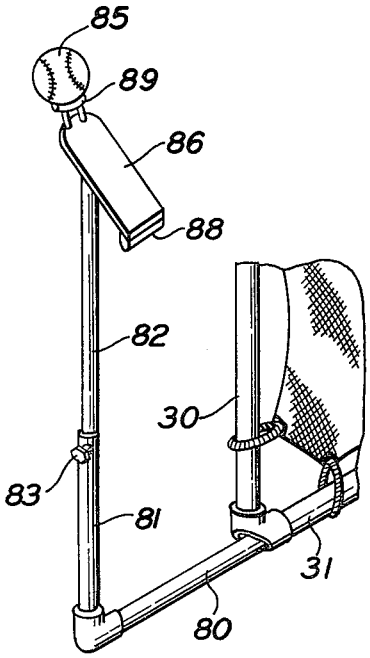
FIG. 14 is a perspective view of a ball supported on a plate which in turn is supported by a rod assembly extending from the side of the target.

The corner fittings provide for the support of any suitable attachments. Several are suggested in the drawings. It is desirable to provide openings on both sides of the frame so that means may be provided for both left- and right-handed players. The attachments in FIGS. 11, 12 and 14 are shown on only one side of the frame but may be positioned on the other side equally well.

Figure 11:
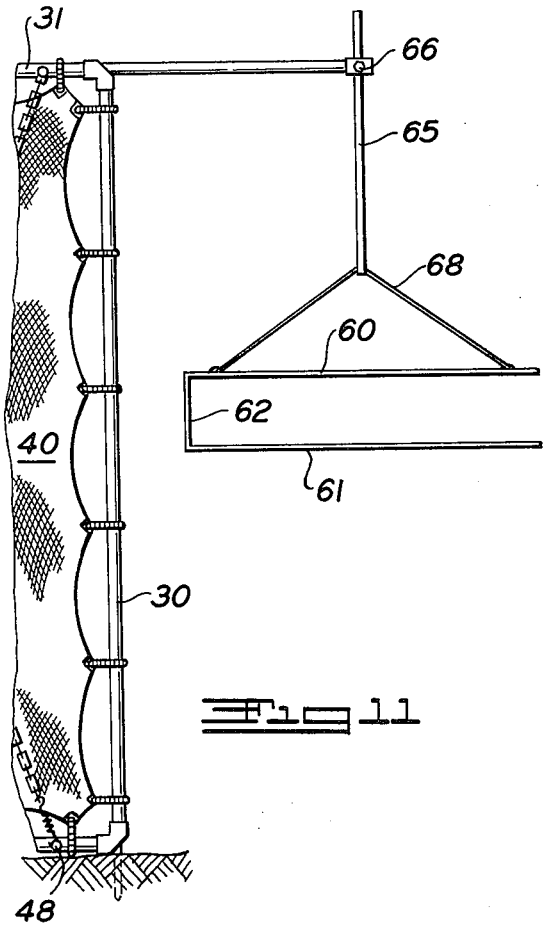
FIG. 11 is a front view of a batting practice guide attached to the side of the target.
Figure 12:
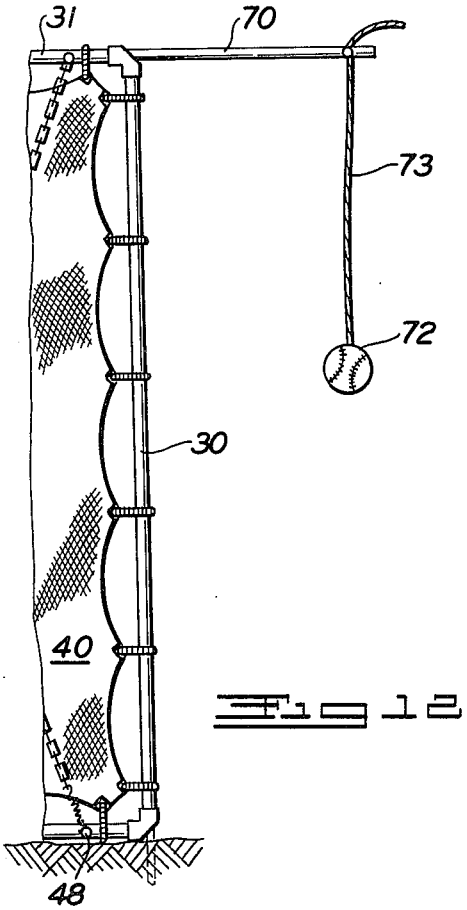
FIG. 12 is a front view showing a ball suspended at the side of the target.

The essential parts of the attachment in FIG. 11 are the horizontal members 60 and 61, which serve as a guide in batting practice. These may be in the form of a bent wire, as shown, with the members held together by the section 62 of the wire. They may be sticks or pipes suitably held at a distance. These spaced members are supported from above by the rod 64 supported from rod 65 and held at an adjustable height by the set screw 66. As shown, the arrangement is for a left-handed. batter. He will learn to swing between the bars. The member 62 may be replaced by a member of adjustable length. The bars are held at a greater or less distance from the ground, depending upon the height of the batter. The supporting member 68 is preferably a chain or a rope or other flexible support so that the bars will simply tend to revolve if they are hit by the bat.

A simpler device comprises only an extending arm 70 from which a ball 72, the size of a baseball, is suspended by a cord or chain or other flexible member 73. This is adapted to be hung any suitable distance from the arm by simply tying it to the arm or holding it by other suitable adjusting means.

Alternatively, the ball may be supported by a rod or the like 80 which extends from the end of the lower pipe 31. This holds the upright 81 in which rod 82 is telescoped and held at an adjustable height by set screw 83. The ball 85 is supported on the small plate 86 hingedly supported at the top of rod 82 by hinge means (not shown). The plate is weighted at 88.

If the person practicing batting practice hits the ball, it is lifted off the small plate support 89. If the batter hits low, the bat merely causes the plate to pivot, and no damage is done to the apparatus. The ball is advantageously provided from a small number which may be in a bag. After one is hit, another is provided from the bag, much as a golfer hits a number of balls in succession, and then recovers all of them.

The practice devices shown may be used by a person who is unattended, or several persons may take turns. The person may be accompanied by a coach who can readily analyze the pitch or the swing of a batter or the manner a ball is fielded, and offer advice.

It is to be understood that the invention is not limited to the particular structures shown and described. Any suitable elongated, flexible members of small cross-section may be used instead of chains 10, 11, 14 and 15, such as cords, wires, etc.; and in that case any suitable connecting means will replace the open links 17. A suitable replacement for the vertical chains 10 and 11 would be looped cord, i.e. a cord which is looped at frequent intervals. Cross members 14 and 15 would be provided at their ends with suitable attaching means for engagement in the loops. If looped cords are used in place of vertical chains, the cross-members 14 and 15 may be cords tied into the loops, no separate attachment means being required. Also the springs 12 may be replaced by rubber or any other elastic means, and the elastic means may be located anywhere along the vertical members 10 and 11. Any suitable means of attaching the strike-zone target to the backstop may be used. Similarly, the frame structure and attachments are illustrated by reference to suggestive structural elements.

I claim:

1. A strike-zone target for baseball practice which comprises a vertical backstop which is a wall designed primarily for another use, two vertical, elongate, flexible slightly extensible members said vertical members each being fastened at its top and bottom to the backstop by projecting means all of which are substantially the same length, at locations spaced somewhat more than seventeen inches from one another; and two vertically spaced, horizontal, elongate flexible means shiftably engaged with said vertical members to define targets of varied sizes and located at varied distances from the ground and drawing the vertical members toward one another, whereby the vertical and horizontal members define a rectangular strike-zone target somewhat over seventeen inches wide, said strike-zone target being spaced 2 to 5 inches in front of the backstop.

2. The target of claim 1 in which each vertical member is a chain with elastic means at one end thereof, and each horizontal means is a chain with a hook at each end thereof.

3. Apparatus for forming and mounting an open baseball strike-zone target on a substantially vertical backstop, which apparatus comprises four attachment means of substantially the same length for engagement in the backstop which are adapted for mounting the strike-zone target thereon 2 to 5 inches in front of and substantially parallel to the backstop, two elongate, flexible members having openings therealong which flexible members incorporate elastic means to retain the members taut when in mounted condition which flexible members are longer than the height of the strike zone, and two shorter elongate, flexible members each having means at each end thereof adapted for ready engagement and disengagement in different openings along the length of the first-mentioned elongate, flexible members, the length of each shorter member being somewhat over 17 inches.

4. The apparatus of claim 3 in which the four flexible members define a rectangular area with substantially vertical sides and there is at least one additional member with its ends fastened to two flexible members which are adjacent one another and the additional member marks out an area for a "high and tight" pitch or a "low and away pitch".

5. In combination, a strike-zone target for baseball practice and substantially vertical support member therefor, said target including two vertical, elongate, flexible members which incorporate elastic members to render them only slightly extensible, said vertical members being supported at their ends from said support member at locations somewhat more than 17 inches from one another, and two vertically spaced, horizontal, elongate, flexible members so detachably engaged with said vertical members as to be vertically shiftable therealong to define targets of different sizes said horizontal members drawing the vertical members toward one another.

6. The target combination of claim 5 in which the vertical and horizontal members are chains.

7. The combination of claim 5, wherein said substantially vertical support member is an open generally rectangular frame of larger dimensions than the target composed of elongated hollow members to which the ends of the vertical members are attached, a backstop larger than the target givingly supported by said frame, and a fitting in at least one corner of the frame, which corner is formed by the juncture of two of said hollow members, said fitting having therein an opening which permits insertion of an elongated member through said fitting and into the hollow of at least one of said two hollow members at said corner.

8. The combination of claim 7 in which there are fittings in each lower corner of said frame each fitting having an opening therein which permits insertion of a member through said opening and into one of the hollow members.

9. The combination of claim 7 wherein the frame has four corners, each corner having a fitting therein, with an opening in each fitting which permits insertion of a member through the opening into either one of the hollow members which form each of the corners.

10. The combination of claim 9 with an opening in one of the upper fittings, a rigid member in the fitting and means with vertically spaced upper and lower horizontal members supported therefrom, which members serve as a guide in batting practice.

11. The combination of claim 10 in which the horizontal members are parts of a bent wire connected by another portion of the wire.

12. The combination of claim 7 in which there is a fitting in each of the two bottom corners of said frame with an opening therein, and stakes supported in a base which extend upwardly through the openings into the side members of the frame.

13. The combination of claim 7 in which there is an opening near each of the two upper corners of the frame perpendicular to the plane of the frame, and a member passed through each of said last recited openings with their outer ends supporting said target.

14. The combination of claim 9 with a horizontal member passed through an opening in an upper fitting and extending into the top member of the frame, and a ball the size of a baseball supported from said horizontal member by flexible means.

15. The combination of claim 9 and a rigid angular member one portion of which extends through an opening in a fitting in a bottom corner of the frame into the bottom member of the frame, anda support for a baseball flexibly supported on the other end of the angular member.

* * * * *